United States Patent [19]

Switlik, II

[11] 4,406,348

[45] Sep. 27, 1983

[54] CLIP FOR SAFETY HARNESSES

[76] Inventor: Stanley Switlik, II, 110 W. Welling Ave., Pennington, N.J. 08534

[21] Appl. No.: 328,560

[22] Filed: Dec. 9, 1981

[51] Int. Cl.[3] ..... A62B 35/00

[52] U.S. Cl. ..... 182/3; 119/96

[58] Field of Search ..... 182/3, 4, 5, 6, 7, 8, 182/9, 231; 24/131 R, 315, 190, 200, 164, 168, 169; 244/151 R, 151 A, 151 B; 224/160, 210, 211, 212, 261, 262; 119/96, 101

[56] References Cited

U.S. PATENT DOCUMENTS

| | | | |
|---|---|---|---|
| 472,040 | 4/1892 | Foster . | |
| 517,658 | 4/1894 | Ogden . | |
| 884,521 | 4/1908 | Petterson | 24/131 |
| 1,187,836 | 6/1916 | Hoekstra . | |
| 1,279,206 | 9/1918 | Wolfe . | |
| 2,426,768 | 9/1947 | Farmer | 24/131 |
| 2,835,010 | 5/1958 | Bayon | 24/315 |
| 3,258,788 | 7/1966 | Anciaux | 182/3 |
| 3,442,427 | 5/1969 | Arnell | 224/261 |
| 3,849,838 | 11/1974 | Hehl . | |
| 4,076,101 | 2/1978 | Himmelrich | 182/3 |

FOREIGN PATENT DOCUMENTS

| | | | |
|---|---|---|---|
| 1501945 | 2/1978 | United Kingdom | 182/8 |

*Primary Examiner*—Reinaldo P. Machado
*Assistant Examiner*—Alvin C. Chin-Shue
*Attorney, Agent, or Firm*—Frederick A. Zoda; John J. Kane

[57] ABSTRACT

A safety harness of the type worn by boatmen to facilitate their being tethered to an adjacent support during rough seas, includes a clip formed from a single length of stiff wire material bent to a U-shape. The U-shaped body of the clip essentially comprises a pair of U-shaped clip members having legs the distal ends of which are jointed to maintain the members in spaced, parallel planes. The clip is usable to particular advantage with a buckle element such as a D-ring. When the cross bar of the D-ring extends across the U-shaped body within the space defined between the planes of the clip members, the clip serves to connect to each other a shoulder strap and a chestband to one of which the D-ring is connected. The clip connects the straps at right angles to each other, with the interengaged straps being confined substantially entirely to the space between the planes of the clip members. The clip in this relationship to the straps snugly and tightly interengages the straps with each other and with the D-ring, in any of various selected positions to which the straps may be adjusted upon the body of the user.

9 Claims, 11 Drawing Figures

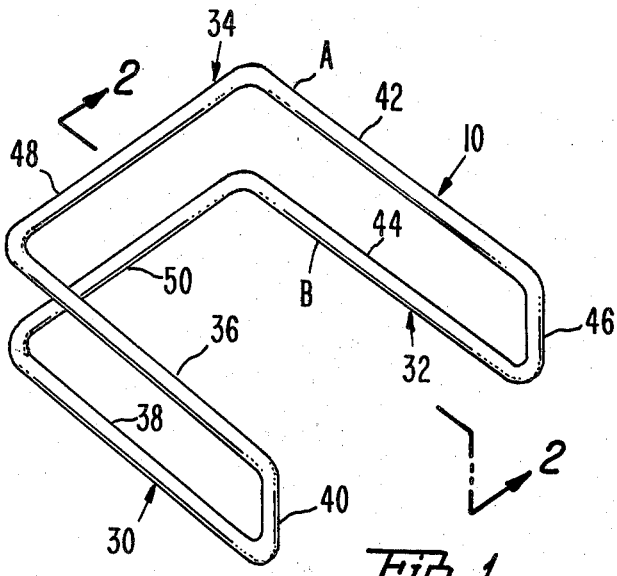
Fig. 1.
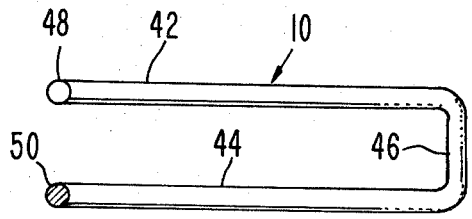
Fig. 2.
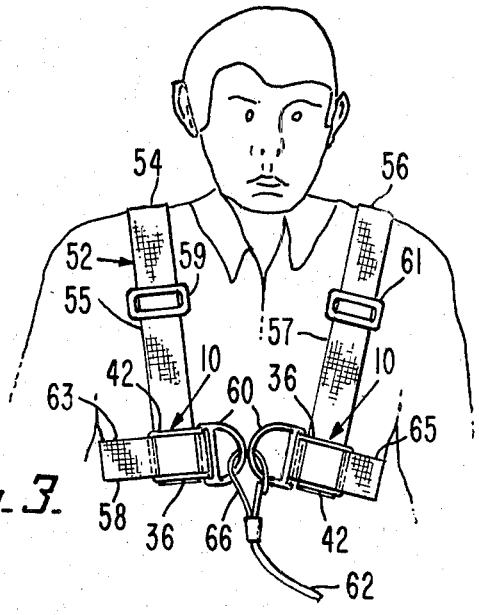
Fig. 3.
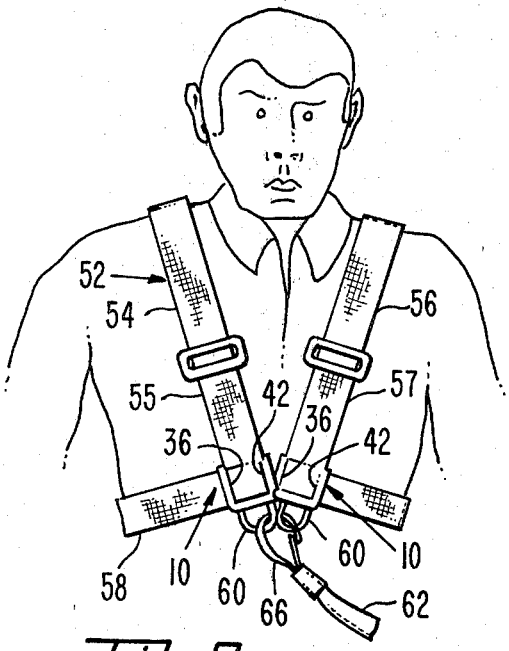
Fig. 7.
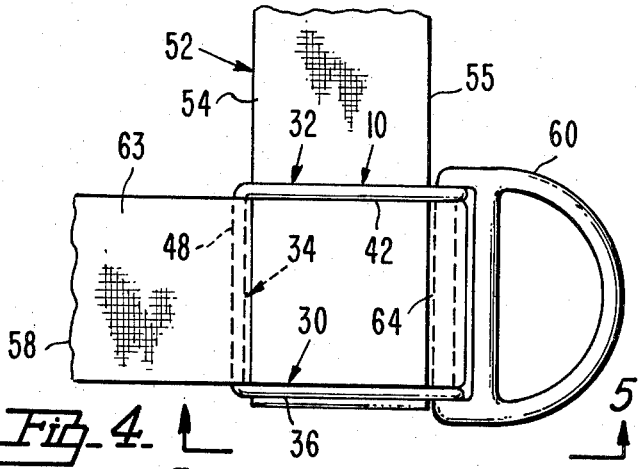
Fig. 4.
Fig. 6.
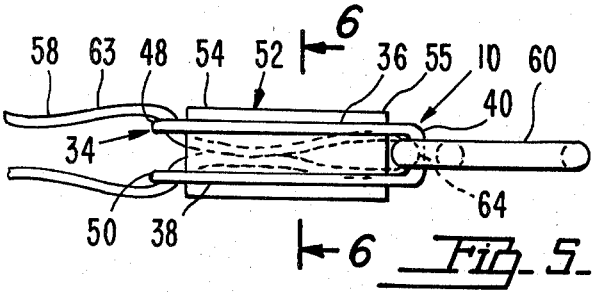
Fig. 5.
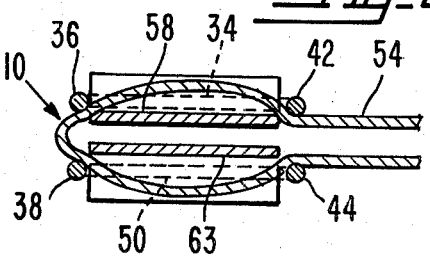

CLIP FOR SAFETY HARNESSES

BACKGROUND OF THE INVENTION

1. Field of the Invention

The present invention relates generally to the field of safety harnesses such as those used by yachtsmen and by crew members of fishing or other commercial vessels. In a more particular sense the invention relates to a novelly designed clip, which is specially formed and designed to interengage, at right angles to each other, a shoulder strap and chestband of a safety harness, with one of the straps carrying a D-ring or equivalent buckle element used to connect the chestband or belt about the wearer's body while permitting connection of a tether thereto.

2. Description of the Prior Art

Safety harnesses of the type including a pair of shoulder straps and a belt extendable about the waist or torso of the user, are very well known. Typically, the shoulder and belt straps of such a harness are adjustable in length to the physique of the particular wearer, as a result of which the several straps are of double thickness, having loops at their ends where they are to be joined together and connected to their associated D-rings.

Connecting the straps together at the location of the D-rings has been achieved in various ways, mostly in a manner that prevents their ready adjustment. It is desirable to provide a floating arrangement in which the D-ring accommodates itself to adjustments in length of both the belt and the shoulder straps, and this has been difficult with the strap arrangements heretofore conceived and now in regular commercial use.

The joining of two individually adjustable, floating webbings or straps in a harness of this type has, thus, presented difficulties. The adjustments are conventionally effected through the provision of an adjustable loop on each strap or webbing, adapted to be extended or shortened, as desired, by means of a selectively positioned buckle element.

As a result, the location at which the webbings or straps intersect may shift with the adjustment, to an undesirable extent, and it is in any event difficult to securely connect the intersecting webbings to each other for maximum comfort and for full efficiency in donning and wearing the harness.

SUMMARY OF THE INVENTION

Summarized briefly, the invention is a harness improvement in the form of a specially designed clip that is readily and easily applied to a D-ring or equivalent connecting element, and also to intersecting adjustment loops of floating straps or webbings of a safety harness. The clip may be readily formed from a single length of stiff wire material, which would initially be in the form of a rectangle bent upon itself medially between its ends. The clip, thus, in its final form is generally U-shaped, comprising a pair of like U-shaped members disposed in parallel planes and connected at the distal ends of the legs of the U's. When applied to straps or webbings of a harness that are disposed at right angles to each other with the adjustment loop of one strap extending through that of the other strap or webbing, the legs of the clip embrace the outer adjustment loop. The bight portion extends within the inner adjustment loop. The cross bar of the buckle element, which extends through the inner adjustment loop, also extends through the clip itself.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

FIG. 1 is a perspective view of the clip per se;

FIG. 2 is a sectional view therethrough on line 2—2 of FIG. 1;

FIG. 3 is a view showing a safety harness with a pair of the clips applied thereto;

FIG. 4 is a fragmentary, plan view of the clip on a scale enlarged above that of FIG. 3, as it appears when in use, webbings joined by the clip being shown fragmentarily;

FIG. 5 is a view on the same scale as FIG. 4, showing the clip and webbings as seen from line 5—5 of FIG. 4;

FIG. 6 is a transverse sectional view through the clip and webbings, on the same scale as FIG. 4, taken substantially on line 6—6 of FIG. 5;

FIG. 7 is a view like FIG. 3 showing the clip in an application mode different from that of FIG. 3, wherein the D-rings are in side-by-side rather than in confronting relation.

DESCRIPTION OF THE PREFERRED EMBODIMENT

Figure 8:
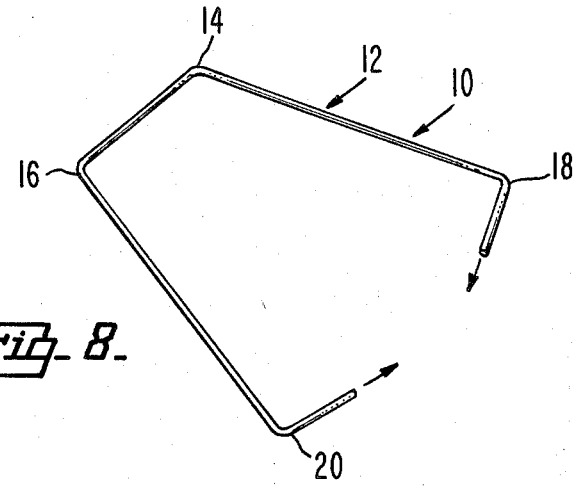
FIGS. 8–11 are perspective views showing the clip at successively following stages of its manufacture.
Figure 9:
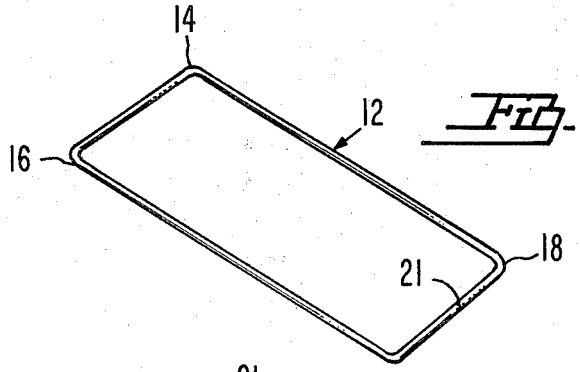

The clip comprising the present invention is manufactured, in a preferred embodiment, from a single length of wire, following the steps shown in FIGS. 8–11. The length of wire may be appropriately described as a one piece wire body generally designated 10 formed from a length of stiff, strong wire material 12 formed with right-angular bends 14, 16, 18, 20 at selected locations along its length. The ends of the wire are brought together as shown in FIG. 8 to produce an elongated, open rectangular wireform shown in FIG. 9. The abutting ends 21 of the rectangular wireform may be permanently joined by a weld or the like, but this is not critical to successful use of the invention.

Figure 10:
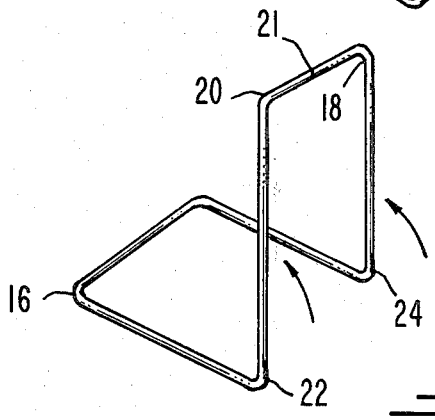
Figure 11:
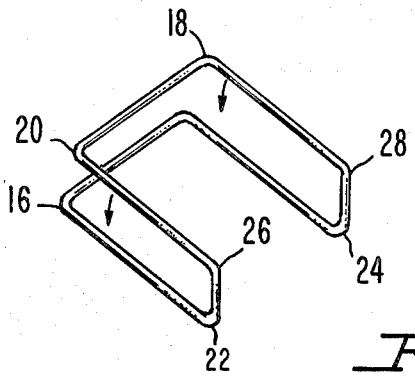

Referring to FIG. 10, the rectangular wireform is bent upon itself as at 22, 24, along its respective sides. Adjacent the bend points 22, 24, the sides are bent upon themselves again, as at 26, 28 respectively. This is illustrated in FIG. 11, and when these bends are formed, and the rectangular wireform is folded back upon itself, the clip assumes its final shape shown in FIG. 1.

The clip, in its final form, may appropriately be described as a U-shaped body having legs 30, 32, and a bight or connecting portion 34.

Leg 30 comprises parallel, spaced leg elements 36, 38 respectively. The distal ends of the leg elements, that is, the ends remote from their integral connection to the bight portion, are joined by a connecting element 40.

Similarly, parallel, spaced leg elements 42, 44 of the leg 32 are joined at their distal ends by a connecting element 46.

The bight portion 34 comprises spaced, parallel leg elements 48, 50. Leg element 48 is integral at its ends with the leg elements 36, 42. Leg element 50 is integral at its respective ends with the leg elements 38, 44.

In another sense, the clip may be considered as comprising a pair of parallel, U-shaped clip members A, B. Each clip member is of U-shape, and is identical to the other clip member. The clip members are spaced apart, lying in parallel planes, and are joined only at the distal ends of their legs or sides, where they are connected by the elements 40, 46.

In use, a pair of the clips would be provided in each safety harness. A safety harness in which the clips can be advantageously employed has been generally designated 52 in FIGS. 3–6. It includes a pair of shoulder straps or webbings 54, 56 respectively. As will be readily understood, they may if desired be crossed over the back of the wearer (not shown) and would there be joined to the back portion of a waist or chest encircling belt, strap, or webbing 58. The connection of the shoulder straps to the belt at the back is considered sufficiently obvious as not to require special illustration. A typical arrangement in this regard is shown, for example, in U.S. Pat. No. 4,112,865 issued to Carn. The disclosure of that patent, with respect to the connection of the shoulder straps to the waistband at the back of the wearer, can be used in the present invention and is incorporated herein by reference.

The present invention lies not in the back connections, but rather, in the manner in which the shoulder straps and the chest belt 58 are connected at the front of the harness.

Each clip tightly interengages the adjustment loop of a shoulder strap with the adjustment loop and D-ring 60 of an end of the chest belt or strap 58. Since the arrangement is the same at both ends of the chest belt, the description of one will suffice for the other.

At this point, it may be noted that the shoulder straps 54, 56 of harness 52, as shown in FIG. 3 have adjustment loops 55, 57 respectively, the length of which can be adjusted to suit the wearer through the provision of take-up elements 59, 61.

Similarly, the opposite ends of the chest belt are formed with adjustment loops 63, 65.

As seen from FIGS. 4 and 5, the cross bar 64 of D-ring 60 extends through adjustment loop 63 in the chest and shoulder strap connection selected for description herein. The cross bar also extends transversely between the legs 30, 32. The bight portion 34 of the clip extends within the chest belt adjustment loop 63 (FIG. 5). The chest belt adjustment loop extends through the shoulder strap adjustment loop 55. In turn, the shoulder strap adjustment loop 55, which may be termed as the outer loop, and the chest belt loop 63 (inner loop) are embraced by and extended through the space between the clip elements 36, 38 and 42, 44 of the respective legs 30, 32.

A harness of the type illustrated is used in association with a tether 62, which is provided with a snap clasp 66 adapted to be connected to both D-rings 60.

In use of the invention, thus, the D-rings may be applied with their cross bars passing through the adjustment loops 63, 65 of the end portions of the chest belt. Alternatively, the D-rings may be used as in FIG. 7, with their cross bars passing through the adjustment loops 55, 57 of the shoulder straps.

In either event, the clip is applicable to the loop-shaped end portions of associated straps that are to be connected to each other at right angles, with one of the straps receiving the cross bar of a buckle element such as a D-ring. When the clip is applied as shown in FIGS. 4–6, the intersecting straps, joined at right angles, are securely connected in such a manner that the floating, normally relatively movable end portions of the straps are secured tightly to each other next to the buckle element. The secure connection prevents "floating" or relative movement of the straps once they are connected. At any time, either or both straps that are connected may be adjusted to suit the wearer. After the adjustment is made, they will remain securely connected and will be maintained snugly against relative movement from the position shown in FIG. 3 or in FIG. 7.

The construction dispenses with the necessity of large connecting plates or the like, such as are shown, for example, in the above-mentioned Carn U.S. Pat. No. 4,112,865. At the same time, the clip is not only adapted to provide a highly efficient way of connecting straps at right angles in a safety harness of the type illustrated and described herein, but also, the clip can be itself manufactured at a very low cost, since it is made from a single piece of stiff wire material. The clip can be formed, of course, with wire-forming equipment of a conventional nature, such as a four-slide press or the like.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. In a harness including first and second straps to be interengaged at one end with said one end of one of the straps connected to a buckle element, the improvement comrising a clip of U-shape having legs each of which includes a pair of spaced leg elements embracing the other strap, each leg additionally including a connecting element joining the leg elements and engaging the buckle element.

2. In a harness, the improvement of claim 1 in which said clip is formed of a stiff wire material.

3. In a harness, the improvement of claim 2 in which said clip is formed of a single length of said wire material.

4. In a harness, the improvement of claim 3 in which said length of wire material is a rectangular wireform bent upon itself intermediate its ends to produce said U-shaped clip body.

5. In a harness, the improvement of claim 1 in which the clip further includes a bight portion connecting the respective legs and extending through said one strap.

6. In a harness, the improvement of claim 1 in which the clip comprises a pair of U-shaped clip members, said members including leg elements having distal ends joined together to locate said clip members in spaced parallel planes.

7. In a harness, the improvement of claim 1 in which the clip includes a bight portion extending through said one strap.

8. In a harness, the improvement of claim 1 in which said other strap is looped about said one strap, and said one strap is of double thickness with its respective thicknesses in embracing relation to said bight portion.

9. In a harness including a pair of shoulder straps having end portions formed as adjustment loops, a chest strap having end portions also formed as adjustment loops to which the respective shoulder strap end portions are to be connected, and buckle elements connected to the end portions of related ones of said straps, the improvement that comprises a clip for connecting the end portion of one of said straps to the end portion of a second one of said straps and to one of said buckle elements, each clip comprising: a U-shaped body including a pair of legs and a bight portion connecting the legs at one end of the legs, each leg comprising a pair of spaced parallel leg elements, the bight portion comprising spaced parallel bight elements into which the leg elements are merged at one end of the leg elements, said body including a pair of connecting elements each of which extends between and connects the other ends of the leg elements of a leg, each buckle element extending transversely between the legs adjacent the respective connecting elements through the loop of said one strap, the bight elements extending through the loop of said one strap, the loop of said one strap extending through the loop of said other strap between the legs within the spaces occurring between the leg elements of each leg.

* * * * *